US011122386B2

(12) United States Patent
Filos et al.

(10) Patent No.: US 11,122,386 B2
(45) Date of Patent: Sep. 14, 2021

(54) AUDIO RENDERING FOR LOW FREQUENCY EFFECTS

(71) Applicant: QUALCOMM Incorporated, San Diego, CA (US)

(72) Inventors: Jason Filos, San Diego, CA (US); Andre Schevciw, San Diego, CA (US); Graham Bradley Davis, Del Mar, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/714,468

(22) Filed: Dec. 13, 2019

(65) Prior Publication Data

US 2020/0404446 A1 Dec. 24, 2020

(30) Foreign Application Priority Data

Jun. 20, 2019 (GR) ..... 20190100269

(51) Int. Cl.
*H04S 7/00* (2006.01)
*H04S 3/00* (2006.01)
(Continued)

(52) U.S. Cl.
CPC ..... *H04S 7/307* (2013.01); *G10L 25/18* (2013.01); *G10L 25/21* (2013.01); *H04S 3/008* (2013.01);
(Continued)

(58) Field of Classification Search
CPC ..... H04S 7/307; H04S 3/008; H04S 2400/01; H04S 2400/11; H04S 2420/11; G10L 25/18; G10L 25/21
See application file for complete search history.

(56) References Cited

U.S. PATENT DOCUMENTS

2011/0249821 A1 10/2011 Jaillet et al.
2014/0219456 A1* 8/2014 Morrell ..... H04S 7/30 381/17
(Continued)

FOREIGN PATENT DOCUMENTS

WO 2015147434 A1 10/2015

OTHER PUBLICATIONS

Audio: "Call for Proposals for 3D Audio", International Organisation for Standardisation Organisation Internationale De Normalisation ISO/IEC JTC1/SC29/WG11 Coding of Moving Pictures and Audio, ISO/IEC JTC1/SC29/WG11/N13411, Geneva, Jan. 2013, pp. 1-20.
(Continued)

*Primary Examiner* — Fan S Tsang
*Assistant Examiner* — Daniel R Sellers
(74) *Attorney, Agent, or Firm* — QUALCOMM Incorporated

(57) ABSTRACT

In general, various aspects of the techniques are directed to audio rendering for low frequency effects. A device comprising a memory and a processor may be configured to perform the techniques. The memory may store audio data representative of a soundfield. The processor may analyze the audio data to identify spatial characteristics of low frequency effects components of the soundfield, and process, based on the spatial characteristics, the audio data to render a low frequency effects speaker feed. The processor may also output the low frequency effects speaker feed to a low frequency effects capable speaker.

28 Claims, 5 Drawing Sheets

(51) Int. Cl.
*G10L 25/18* (2013.01)
*G10L 25/21* (2013.01)

(52) U.S. Cl.
CPC ..... *H04S 2400/01* (2013.01); *H04S 2400/11* (2013.01); *H04S 2420/11* (2013.01)

(56) References Cited

U.S. PATENT DOCUMENTS

| | | | | |
|---|---|---|---|---|
| 2014/0358557 | A1* | 12/2014 | Sen | G10L 19/008 704/500 |
| 2015/0264483 | A1 | 9/2015 | Morrell et al. | |
| 2015/0271621 | A1* | 9/2015 | Sen | G10L 19/008 381/303 |
| 2016/0066118 | A1* | 3/2016 | Oh | H04S 3/008 381/303 |
| 2019/0007781 | A1 | 1/2019 | Peters et al. | |

OTHER PUBLICATIONS

ETSI TS 103 589 V1.1.1, "Higher Order Ambisonics (HOA) Transport Format", Jun. 2018, 33 pages.

Herre J., et al., "MPEG-H 3D Audio—The New Standard for Coding of Immersive Spatial Audio," IEEE Journal of Selected Topics In Signal Processing, Aug. 1, 2015 (Aug. 1, 2015), vol. 9(5), pp. 770-779, XP055243182, US ISSN: 1932-4553, DOI: 10.1109/JSTSP.2015.2411578.

Hollerweger F., "An Introduction to Higher Order Ambisonic," Oct. 2008, pp. 13, Accessed online [Jul. 8, 2013] at <URL: flo.mur.at/writings/HOA-intro.pdf>.

"Information technology—High Efficiency Coding and Media Delivery in Heterogeneous Environments—Part 3: 3D Audio," ISO/IEC JTC 1/SC 29/WG11, ISO/IEC 23008-3, 201x(E), Oct. 12, 2016, 797 Pages.

"Information technology—High efficiency coding and media delivery in heterogeneous environments—Part 3: 3D Audio," ISO/IEC JTC 1/SC 29N, Apr. 4, 2014, 337 pp.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.

Peterson J., et al., "Virtual Reality, Augmented Reality, and Mixed Reality Definitions," EMA, version 1.0, Jul. 7, 2017,4 pp.

Poletti M.A., "Three-Dimensional Surround Sound Systems Based on Spherical Harmonics", The Journal of the Audio Engineering Society, vol. 53, No. 11, Nov. 2005, pp. 1004-1025.

Schonefeld V., "Spherical Harmonics," Jul. 1, 2005, XP002599101, 25 Pages, Accessed online [Jul. 9, 2013] at URL:http://heim.c-otto.de/~volker/prosem_paper.pdf.

Sen D., et al., "RM1-HOA Working Draft Text", 107. MPEG Meeting; Jan. 13, 2014-Jan. 17, 2014; San Jose; (Motion Picture Expert Group or ISO/IEC JTC1/SC29/WG11), No. m31827, Jan. 11, 2014 (Jan. 11, 2014), 83 pages, XP030060280.

Sen D., et al., "Technical Description of the Qualcomm's HoA Coding Technology for Phase II", 109. MPEG Meeting; Jul. 7, 2014-Jul. 11, 2014; Sapporo; (Motion Picture Expert Group or ISO/IEC JTC1/SC29/WG11), No. m34104, Jul. 2, 2014 (Jul. 2, 2014), XP030062477, figure 1, 4 pages.

WG11: "Proposed Draft 1.0 of TR: Technical Report on Architectures for Immersive Media", ISO/IEC JTC1/SC29/WG11/N17685, San Diego, US, Apr. 2018, 14 pages.

Boehm J., "Decoding for 3D," AES Convention 130; May 2011, AES, 60 East 42nd Street, room 2520 New york 10165-2520, USA, May 13, 2011 (May 13, 2011), pp. 1-16, XP040567441, Section 3, paragraph [03.4]—paragraph [04.2].

International Search Report and Written Opinion—PCT/US2020/037926—ISA/EPO—dated Oct. 15, 2020 15 Pages.

* cited by examiner

AUDIO RENDERING FOR LOW FREQUENCY EFFECTS

This application claims the benefit of Greece Patent Application No. 20190100269, filed Jun. 20, 2019, the entire contents of which are hereby incorporated by reference in its entirety.

TECHNICAL FIELD

This disclosure relates to processing of media data, such as audio data.

BACKGROUND

Audio rendering refers to a process of producing speaker feeds that configure one or more speakers (e.g., headphones, loudspeakers, other transducers including bone conducting speakers, etc.) to reproduce a soundfield represented by audio data. The audio data may conform to one or more formats, including scene-based audio formats (such as the format specified in the motion picture experts group—MPEG-H audio coding standard), object-based audio formats, and/or channel-based audio formats.

An audio playback device may apply an audio renderer to the audio data in order to generate or otherwise obtain the speaker feeds. In some instances, the audio playback device may process the audio data to obtain one or more speaker feeds dedicated for reproducing low frequency effects (LFE, which may also be referred to as bass below a threshold, such as 120 or 150 Hertz) that is potentially output to a LFE capable speaker, such as a subwoofer.

SUMMARY

This disclosure relates generally to techniques directed to audio rendering for low frequency effects (LFE). Various aspects of the techniques may enable spatialized rendering of LFE to potentially improve reproduction of low frequency components (e.g., below a threshold frequency of 200 Hertz—Hz, 150 Hz, 120 Hz, or 100 Hz) of the soundfield. Rather than process all aspects of the audio data equally to obtain the LFE speaker feeds, various aspects of the techniques may analyze the audio data to identify spatial characteristics associated with the LFE components, and process, based on the spatial characteristics, the audio data (e.g., render) in various ways more to possibly more accurately spatialize the LFE components within the soundfield.

As such, various aspects of the techniques may improve operation of audio playback devices as potentially more accurate spatialization of the LFE components within the soundfield may improve immersion and thereby the overall listening experience. Further, various aspects of the techniques may address issues in which the audio playback device may be configured to reconstruct the LFE components of the soundfield when dedicated LFE channels are corrupted or otherwise incorrectly coded by the audio data, using LFE embedded in other middle (often, referred to as mid) or high frequency components of the audio data, as described in greater detail throughout this disclosure. Through potentially more accurate reconstruction (in terms of spatialization), various aspects of the techniques may improve LFE audio rendering from mid or high frequency components of the audio data.

In one example, the techniques are directed to a device comprising: a memory configured to store audio data representative of a soundfield; and one or more processors configured to: analyze the audio data to identify spatial characteristics of low frequency effects components of the soundfield; process, based on the spatial characteristics, the audio data to render a low frequency effects speaker feed; and output the low frequency effects speaker feed to a low frequency effects capable speaker.

In another example, the techniques are directed to a method comprising: analyzing audio data representative of a soundfield to identify spatial characteristics of low frequency effects components of the soundfield; processing, based on the spatial characteristics, the audio data to render a low frequency effects speaker feed; and outputting the low frequency effects speaker feed to a low frequency effects capable speaker.

In another example, the techniques are directed to a device comprising: means for analyzing audio data representative of a soundfield to identify spatial characteristics of low frequency effects components of the soundfield; means for processing, based on the spatial characteristics, the audio data to render a low frequency effects speaker feed; and means for outputting the low frequency effects speaker feed to a low frequency effects capable speaker.

In another example, the techniques are directed to a non-transitory computer-readable storage medium having stored thereon instructions that, when executed, cause one or more processors of a device to: analyze audio data representative of a soundfield to identify spatial characteristics of low frequency effects components of the soundfield; process, based on the spatial characteristics, the audio data to render a low frequency effects speaker feed; and output the low frequency effects speaker feed to a low frequency effects capable speaker.

The details of one or more examples of this disclosure are set forth in the accompanying drawings and the description below. Other features, objects, and advantages of various aspects of the techniques will be apparent from the description and drawings, and from the claims.

DETAILED DESCRIPTION

Figure 1:
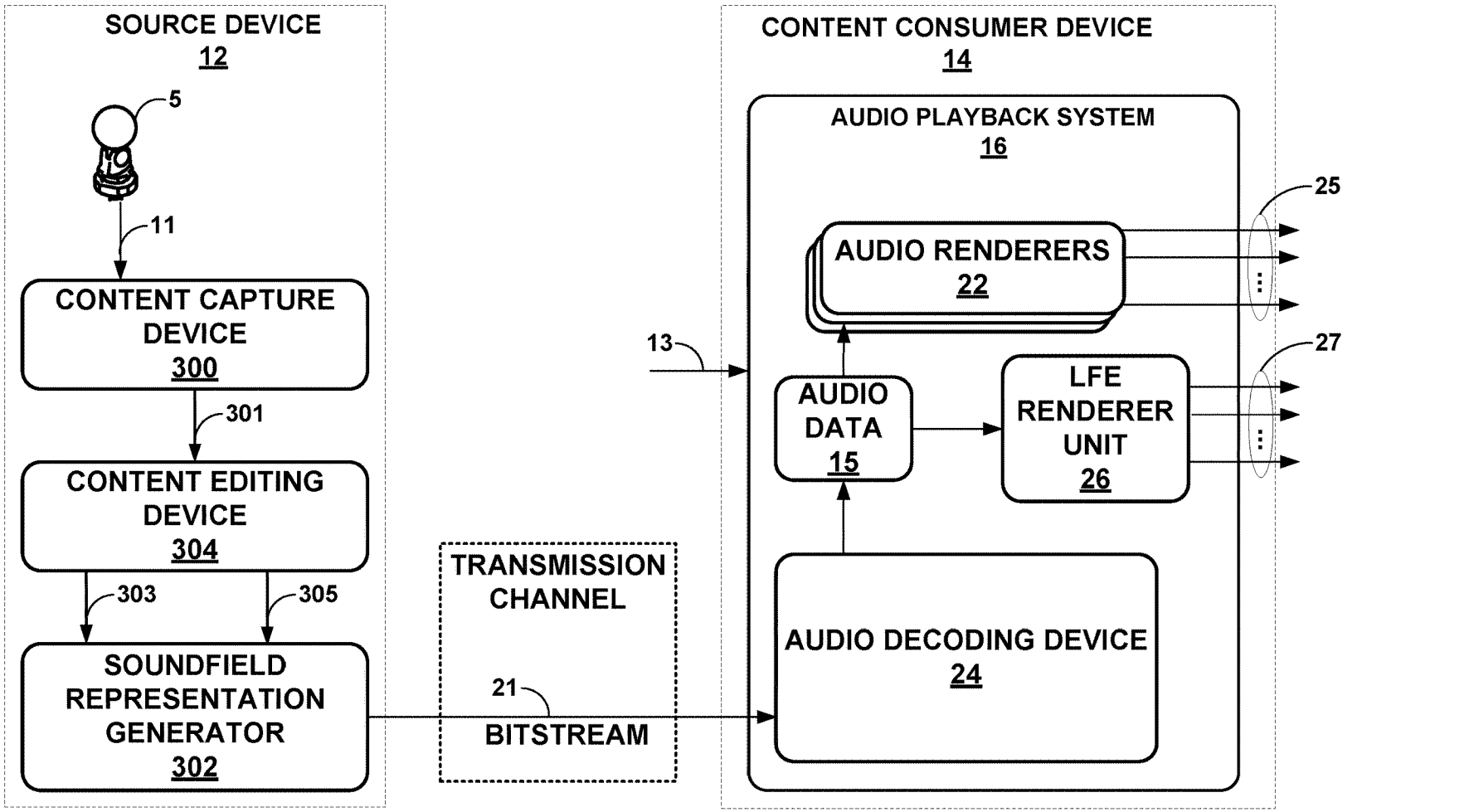
FIG. 1 is a block diagram illustrating an example system that may perform various aspects of the techniques described in this disclosure.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. The Moving Pictures Expert Group (MPEG) has released a standard allowing for soundfields to be represented using a hierarchical set of elements (e.g., Higher-Order Ambisonic—HOA—coefficients) that can be rendered to speaker feeds for most speaker configurations, including 5.1 and 22.2 configuration whether in location defined by various standards or in non-uniform locations.

MPEG released the standard as MPEG-H 3D Audio standard, formally entitled "Information technology—High efficiency coding and media delivery in heterogeneous environments—Part 3: 3D audio," set forth by ISO/IEC JTC 1/SC 29, with document identifier ISO/IEC DIS 23008-3, and dated Jul. 25, 2014. MPEG also released a second edition of the 3D Audio standard, entitled "Information technology—High efficiency coding and media delivery in heterogeneous environments—Part 3: 3D audio, set forth by ISO/IEC JTC 1/SC 29, with document identifier ISO/IEC 23008-3:201x(E), and dated Oct. 12, 2016. Reference to the "3D Audio standard" in this disclosure may refer to one or both of the above standards.

As noted above, one example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions (which may also be referred to as a spherical basis function) of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

The SHC $A_n^m(k)$ can either be physically acquired (e.g., recorded) by various microphone array configurations or, alternatively, they can be derived from channel-based or object-based descriptions of the soundfield. The SHC (which also may be referred to as higher order ambisonic—HOA—coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a number of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$.

Scene-based audio formats, such as the above noted SHC (which may also be referred to as higher order ambisonic coefficients, or "HOA coefficients"), represent one way by which to represent a soundfield. Other possible formats include channel-based audio formats and object-based audio formats. Channel-based audio formats refer to the 5.1 surround sound format, 7.1 surround sound formats, 22.2 surround sound formats, or any other channel-based format that localizes audio channels to particular locations around the listener in order to recreate a soundfield.

Object-based audio formats may refer to formats in which audio objects, often encoded using pulse-code modulation (PCM) and referred to as PCM audio objects, are specified in order to represent the soundfield. Such audio objects may include metadata identifying a location of the audio object relative to a listener or other point of reference in the soundfield, such that the audio object may be rendered to one or more speaker channels for playback in an effort to recreate the soundfield. The techniques described in this disclosure may apply to any of the foregoing formats, including scene-based audio formats, channel-based audio formats, object-based audio formats, or any combination thereof.

FIG. 1 is a block diagram illustrating an example system that may perform various aspects of the techniques described in this disclosure. As shown in the example of FIG. 1, a system 10 includes a source device 12 and a content consumer device 14. While described in the context of the source device 12 and the content consumer device 14, the techniques may be implemented in any context in which audio data is used to reproduce a soundfield. Moreover, the source device 12 may represent any form of computing device capable of generating the representation of a soundfield, and is generally described herein in the context of being a content creator device. Likewise, the content consumer device 14 may represent any form of computing device capable of implementing the audio rendering techniques described in this disclosure as well as audio playback, and is generally described herein in the context of being an audio/visual (A/V) receiver.

The source device 12 may be operated by an entertainment company or other entity that may generate multichannel audio content for consumption by operators of content consumer devices, such as the content consumer device 14. In some scenarios, the source device 12 may generate audio content in conjunction with video content, although such scenarios are not depicted in the example of FIG. 1 for ease of illustration purposes. The source device 12 includes a content capture device 300, a content editing device 304, and a soundfield representation generator 302. The content capture device 300 may be configured to interface or otherwise communicate with a microphone 5.

The microphone 5 may represent an Eigenmike® or other type of 3D audio microphone capable of capturing and representing the soundfield as audio data 11, which may refer to one or more of the above noted scene-based audio data (such as HOA coefficients), object-based audio data, and channel-based audio data. Although described as being 3D audio microphones, the microphone 5 may also represent other types of microphones (such as omni-directional microphones, spot microphones, unidirectional microphones, etc.) configured to capture the audio data 11.

The content capture device 300 may, in some examples, include an integrated microphone 5 that is integrated into the housing of the content capture device 300. The content capture device 300 may interface wirelessly or via a wired connection with the microphone 5. Rather than capture, or in conjunction with capturing, the audio data 11 via microphone 5, the content capture device 300 may process the audio data 11 after the audio data 11 is input via some type of removable storage, wirelessly and/or via wired input processes. As such, various combinations of the content capture device 300 and the microphone 5 are possible in accordance with this disclosure.

The content capture device 300 may also be configured to interface or otherwise communicate with the content editing device 304. In some instances, the content capture device 300 may include the content editing device 304 (which in some instances may represent software or a combination of software and hardware, including the software executed by the content capture device 300 to configure the content capture device 300 to perform a specific form of content editing). The content editing device 304 may represent a unit configured to edit or otherwise alter content 301 received from content capture device 300, including the audio data 11. The content editing device 304 may output edited content 303 and/or associated metadata 305 to the soundfield representation generator 302.

The soundfield representation generator 302 may include any type of hardware device capable of interfacing with the content editing device 304 (or the content capture device 300). Although not shown in the example of FIG. 1, the soundfield representation generator 302 may use the edited content 303, including the audio data 11 and/or metadata 305, provided by the content editing device 304 to generate one or more bitstreams 21. In the example of FIG. 1, which focuses on the audio data 11, the soundfield representation generator 302 may generate one or more representations of the same soundfield represented by the audio data 11 to obtain a bitstream 21 that includes the representations of the soundfield and/or audio metadata 305.

For instance, to generate the different representations of the soundfield using HOA coefficients (which again is one example of the audio data 11), soundfield representation generator 302 may use a coding scheme for ambisonic representations of a soundfield, referred to as Mixed Order Ambisonics (MOA) as discussed in more detail in U.S. application Ser. No. 15/672,058, entitled "MIXED-ORDER AMBISONICS (MOA) AUDIO DATA FO COMPUTER-MEDIATED REALITY SYSTEMS," and filed Aug. 8, 2017, published as U.S. patent publication no. 20190007781 on Jan. 3, 2019.

To generate a particular MOA representation of the soundfield, the soundfield representation generator 302 may generate a partial subset of the full set of HOA coefficients. For instance, each MOA representation generated by the soundfield representation generator 302 may provide precision with respect to some areas of the soundfield, but less precision in other areas. In one example, an MOA representation of the soundfield may include eight (8) uncompressed HOA coefficients of the HOA coefficients, while the third order HOA representation of the same soundfield may include sixteen (16) uncompressed HOA coefficients of the HOA coefficients. As such, each MOA representation of the soundfield that is generated as a partial subset of the HOA coefficients may be less storage-intensive and less bandwidth intensive (if and when transmitted as part of the bitstream 21 over the illustrated transmission channel) than the corresponding third order HOA representation of the same soundfield generated from the HOA coefficients.

Although described with respect to MOA representations, the techniques of this disclosure may also be performed with respect to full-order ambisonic (FOA) representations in which all of the HOA coefficients for a given order N are used to represent the soundfield. In other words, rather than represent the soundfield using a partial, non-zero subset of the HOA coefficients, the soundfield representation generator 302 may represent the soundfield using all of the HOA coefficients for a given order N, resulting in a total of HOA coefficients equaling $(N+1)^2$.

In this respect, the higher order ambisonic audio data (which is another way to refer to HOA coefficients in either MOA representations or FOA representations) may include higher order ambisonic coefficients associated with spherical basis functions having an order of one or less (which may be referred to as "1st order ambisonic audio data"), higher order ambisonic coefficients associated with spherical basis functions having a mixed order and suborder (which may be referred to as the "MOA representation" discussed above), or higher order ambisonic coefficients associated with spherical basis functions having an order greater than one (which is referred to above as the "FOA representation").

The content capture device 300 or the content editing device 304 may, in some examples, be configured to wirelessly communicate with the soundfield representation generator 302. In some examples, the content capture device 300 or the content editing device 304 may communicate, via one or both of a wireless connection or a wired connection, with the soundfield representation generator 302. Via the connection between the content capture device 300 and the soundfield representation generator 302, the content capture device 300 may provide content in various forms, which, for purposes of discussion, are described herein as being portions of the audio data 11.

In some examples, the content capture device 300 may leverage various aspects of the soundfield representation generator 302 (in terms of hardware or software capabilities of the soundfield representation generator 302). For example, the soundfield representation generator 302 may include dedicated hardware configured to (or specialized software that when executed causes one or more processors to) perform psychoacoustic audio encoding (such as a unified speech and audio coder denoted as "USAC" set forth by the Motion Picture Experts Group (MPEG) or the MPEG-H 3D audio coding standard). The content capture device 300 may not include the psychoacoustic audio encoder dedicated hardware or specialized software and instead may provide audio aspects of the content 301 in a non-psychoacoustic-audio-coded form. The soundfield representation generator 302 may assist in the capture of content 301 by, at least in part, performing psychoacoustic audio encoding with respect to the audio aspects of the content 301.

The soundfield representation generator 302 may also assist in content capture and transmission by generating one or more bitstreams 21 based, at least in part, on the audio content (e.g., MOA representations and/or third order HOA representations) generated from the audio data 11 (in the case where the audio data 11 includes scene-based audio data). The bitstream 21 may represent a compressed version of the audio data 11 and any other different types of the content 301 (such as a compressed version of spherical video data, image data, or text data).

The soundfield representation generator 302 may generate the bitstream 21 for transmission, as one example, across a transmission channel, which may be a wired or wireless channel, a data storage device, or the like. The bitstream 21 may represent an encoded version of the audio data 11, and may include a primary bitstream and another side bitstream, which may be referred to as side channel information. In some instances, the bitstream 21 representing the compressed version of the audio data 11 (which again may represent scene-based audio data, object-based audio data, channel-based audio data, or combinations thereof) may conform to bitstreams produced in accordance with the MPEG-H 3D audio coding standard.

The content consumer device 14 may be operated by an individual, and may represent an A/V receiver client device. Although described with respect to an A/V receiver client device (which may also be referred to as an "A/V receiver," an "AV receiver" or an "AV receiver client device"), content consumer device 14 may represent other types of devices, such as a virtual reality (VR) client device, an augmented reality (AR) client device, a mixed reality (MR) client device, a laptop computer, a desktop computer, a workstation, a cellular phone or handset (including as so-called "smartphone"), a television, a dedicated gaming system, a handheld gaming system, a smart speaker, a vehicle head unit (such as an infotainment or entertainment system for an automobile or other vehicle), or any other device capable of performing audio rendering with respect to audio data 15. As shown in the example of FIG. 1, the content consumer device 14 includes an audio playback system 16, which may refer to any form of audio playback system capable of rendering the audio data 15 for playback as multi-channel audio content.

While shown in the example of FIG. 1 as being directly transmitted to the content consumer device 14, the source device 12 may output the bitstream 21 to an intermediate device positioned between the source device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the source device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content (e.g., in the form of one or more bitstreams 21) stored to the mediums are transmitted (and may include retail stores and other store-based delivery mechanism). In any event, the techniques of this disclosure should not therefore be limited in this respect to the example of FIG. 1.

As noted above, the content consumer device 14 includes the audio playback system 16. The audio playback system 16 may represent any system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode bitstream 21 to output audio data 15. Again, the audio data 15 may include scene-based audio data that in some examples, may form the full second or higher order HOA representation or a subset thereof that forms an MOA representation of the same soundfield, decompositions thereof, such as the predominant audio signal, ambient HOA coefficients, and the vector based signal described in the MPEG-H 3D Audio Coding Standard, or other forms of scene-based audio data. As such, the audio data 15 may be similar to a full set or a partial subset of the audio data 11, but may differ due to lossy operations (e.g., quantization) and/or transmission via the transmission channel.

The audio data 15 may include, as an alternative to, or in conjunction with the scene-based audio data, channel-based audio data. The audio data 15 may include, as an alternative to, or in conjunction with the scene-based audio data, object-based audio data. As such, the audio data 15 may include any combination of scene-based audio data, object-based audio data, and channel-based audio data.

The audio renderers 22 of audio playback system 16 may, after audio decoding device 24 has decoded the bitstream 21 to obtain the audio data 15, render the audio data 15 to output speaker feeds 25. The speaker feeds 25 may drive one or more speakers (which are not shown in the example of FIG. 1 for ease of illustration purposes). Various audio representations, including scene-based audio data (and possibly channel-based audio data and/or object-based audio data) of a soundfield may be normalized in a number of ways, including N3D, SN3D, FuMa, N2D, or SN2D.

To select the appropriate renderer or, in some instances, generate an appropriate renderer, the audio playback system 16 may obtain speaker information 13 indicative of a number of speakers (e.g., loudspeakers or headphone speakers) and/or a spatial geometry of the speakers. In some instances, the audio playback system 16 may obtain the speaker information 13 using a reference microphone and driving the speakers in such a manner as to dynamically determine the speaker information 13. In other instances, or in conjunction with the dynamic determination of the speaker information 13, the audio playback system 16 may prompt a user to interface with the audio playback system 16 and input the speaker information 13.

The audio playback system 16 may select one of the audio renderers 22 based on the speaker information 13. In some instances, the audio playback system 16 may, when none of the audio renderers 22 are within some threshold similarity measure (in terms of the speaker geometry) to the speaker geometry specified in the speaker information 13, generate the one of audio renderers 22 based on the speaker information 13. The audio playback system 16 may, in some instances, generate one of the audio renderers 22 based on the speaker information 13 without first attempting to select an existing one of the audio renderers 22.

When outputting the speaker feeds 25 to headphones, the audio playback system 16 may utilize one of the renderers 22 that provides for binaural rendering using head-related transfer functions (HRTF) or other functions capable of rendering to left and right speaker feeds 25 for headphone speaker playback, such as binaural room impulse response (BRIR) renderers. The terms "speakers" or "transducer" may generally refer to any speaker, including loudspeakers, headphone speakers, bone-conducting speakers, earbud speakers, wireless headphone speakers, etc. One or more speakers may then playback the rendered speaker feeds 25.

Although described as rendering the speaker feeds 25 from the audio data 15, reference to rendering of the speaker feeds 25 may refer to other types of rendering, such as rendering incorporated directly into the decoding of the audio data 15 from the bitstream 21. An example of the alternative rendering can be found in Annex G of the MPEG-H 3D audio coding standard, where rendering occurs during the predominant signal formulation and the background signal formation prior to composition of the soundfield. As such, reference to rendering of the audio data 15 should be understood to refer to both rendering of the actual audio data 15 or decompositions or representations thereof of the audio data 15 (such as the above noted predominant audio signal, the ambient HOA coefficients, and/or the vector-based signal—which may also be referred to as a V-vector).

As described above, the audio data 11 may represent a soundfield including what is referred to as low frequency effects (LFE) components, which may also be referred to as bass below a certain threshold frequency (such as 200 Hertz—Hz, 150 Hz, 120 Hz, or 100 Hz). Audio data conforming to some audio formats, such as the channel-based audio formats, may include a dedicated LFE channel (which is usually denoted as dot one—"X.1"—meaning a single dedicated LFE channel with X main channels, such as center, front left, front right, back left and back right when X is equal to five, "X.2" referring to two dedicated LFE channels, etc.).

Audio data conforming to object-based audio formats may define one or more audio objects and the location of each of the audio objects in the soundfield, which are then transformed into channels that are mapped to the individual speakers, including any subwoofers should sufficient LFE components be present (e.g., below approximately 200 Hz) in the soundfield. The audio playback system 16 may process each audio object, performing a distance measure to identify a distance from which the LFE components originate, a low pass filter to extract any LFE components below a threshold (e.g., 200 Hz), a bass activity detection to identify the LFE components, etc. The audio playback system 16 may then render one or more LFE speaker feeds before processing the LFE speaker feeds to perform dynamic range control, the output of which results in adjusted LFE speaker feeds.

Audio data conforming to the scene-based audio formats may define the soundfield as one or more higher order ambisonic (HOA) coefficients, which are associated with spherical basis functions having an order and suborder greater than or equal to zero. The audio playback system 16 may render the HOA coefficients speaker feeds located equidistant about a sphere (so-called Fliege-Maier points) around a sweet spot (which is another way of referring to an intended listening location) at the center of the sphere. The audio playback system 16 may process each of the rendered speaker feeds in a similar manner to that described above with respect to the audio data conforming to the object-based formats, resulting in adjusted LFE speaker feeds.

In each instance, the audio playback system 16 may equally process each of the channels (either provided in the case of channel-based audio data or rendered in the case of scene-based audio data) and/or audio objects to obtain the adjusted LFE speaker feeds. Each of the channels and/or audio objects are processed equally because a human auditory system is generally considered to be insensitive to a directionality and shape of LFE components of the soundfield, as the LFE components are generally felt (as vibrations) rather than distinctly heard compared to higher frequency components of the soundfield, which can be distinctly localized by the human auditory system.

However, as audio playback systems have advanced to feature an increasing number of LFE-capable speakers (which may refer to full frequency speakers, such as large center speakers, large front right speakers, large front left speakers, etc., in addition to one or more subwoofers—where two or more subwoofers is increasingly becoming common, especially in cinemas and other dedicated viewing and/or listening areas, such as in-home cinema or listening rooms), the lack of spatialization of LFE components may be sensed by the human auditory system. As such, viewers and/or listeners may notice a degradation in immersion when the LFE components are not correctly spatialized when reproduced, where such degradation may be detected when an associated scene being viewed does not correctly match with the reproduction of the LFE components.

The degradation may further be increased when the LFE channel is corrupted (for channel-based audio data) or when the LFE channel is not provided (as may be the case for object-based audio data and/or scene-based audio data). Reconstruction of the LFE channel may involve mixing all of the higher frequency channels together (after rendering the audio objects and/or HOA coefficients to the channels when applicable) and outputting the mixed channels to the LFE-capable speaker, which may not be full band (in terms of frequency) and thereby produce an inaccurate reproduction of the LFE components given that the high frequency components of the mixed channels may muddy or otherwise render the reproduction inaccurate. In some instances, additional processing may be performed to reproduce the LFE speaker feeds, but such processing neglects the spatialization aspect and outputs the same LFE speaker feed to each of the LFE-capable speakers, which again may be sensed by the human auditory system as being inaccurate.

In accordance with the techniques described in this disclosure, the audio playback system 16 may perform spatialized rendering of LFE components to potentially improve reproduction of the LFE components (e.g., below a threshold frequency of 200 Hertz—Hz, 150 Hz, 120 Hz, or 100 Hz) of the soundfield. Rather than process all aspects of the audio data equally to obtain the LFE speaker feeds, the audio playback system 16 may analyze the audio data 15 to identify spatial characteristics associated with the LFE components, and process, based on the spatial characteristics, the audio data (e.g., render) in various ways more to possibly more accurately spatialize the LFE components within the soundfield.

As shown in the example of FIG. 1, the audio playback system 16 may include an LFE renderer unit 26, which may represent a unit configured to spatialize the LFE components of the audio data 15 in accordance with various aspects of the techniques described in this disclosure. In operation, the LFE renderer unit 26 may analyze the audio data 15 to identify spatial characteristics of the LFE components of the soundfield.

To identify the spatial characteristics, the LFE renderer unit 26 may generate, based on the audio data 15, a spherical heat map (which may also be referred to as an "energy map") reflecting acoustical energy levels within the soundfield for one or more frequency ranges (e.g., from zero Hz to 200 Hz, 150 Hz, or 120 Hz). The LFE renderer unit 26 may then identify, based on the spherical heatmap, the spatial characteristics of the LFE components of the soundfield. For example, the LFE renderer unit 26 may identify a direction and shape of the LFE components based on where there is higher energy LFE components in the soundfield relative to other locations within the soundfield. The LFE renderer unit 26 may next process, based on the identified direction, shape and/or other spatial characteristics, the audio data 15 to render an LFE speaker feed 27.

The LFE renderer unit 26 may then output the LFE speaker feed 27 to an LFE-capable speaker (which is not shown in the example of FIG. 1 for ease of illustration purposes). In some instances, the audio playback device 16 may mix the LFE speaker feeds 27 with one or more of the speaker feeds 25 to obtain mixed speaker feeds, which are then output to one or more LFE capable speakers.

In this manner, various aspects of the techniques may improve operation of the audio playback device 16 as potentially allowing for more accurate spatialization of the LFE components within the soundfield may improve immersion and thereby the overall listening experience. Further, various aspects of the techniques may address issues in which the audio playback device 16 may be configured to reconstruct the LFE components of the soundfield when dedicated LFE channels are corrupted or otherwise incorrectly coded by the audio data, using LFE embedded in other middle (often, referred to as mid) or high frequency components of the audio data 15. Through potentially more accurate reconstruction (in terms of spatialization), various aspects of the techniques may improve LFE audio rendering from mid or high frequency components of the audio data 15.

Figure 2:
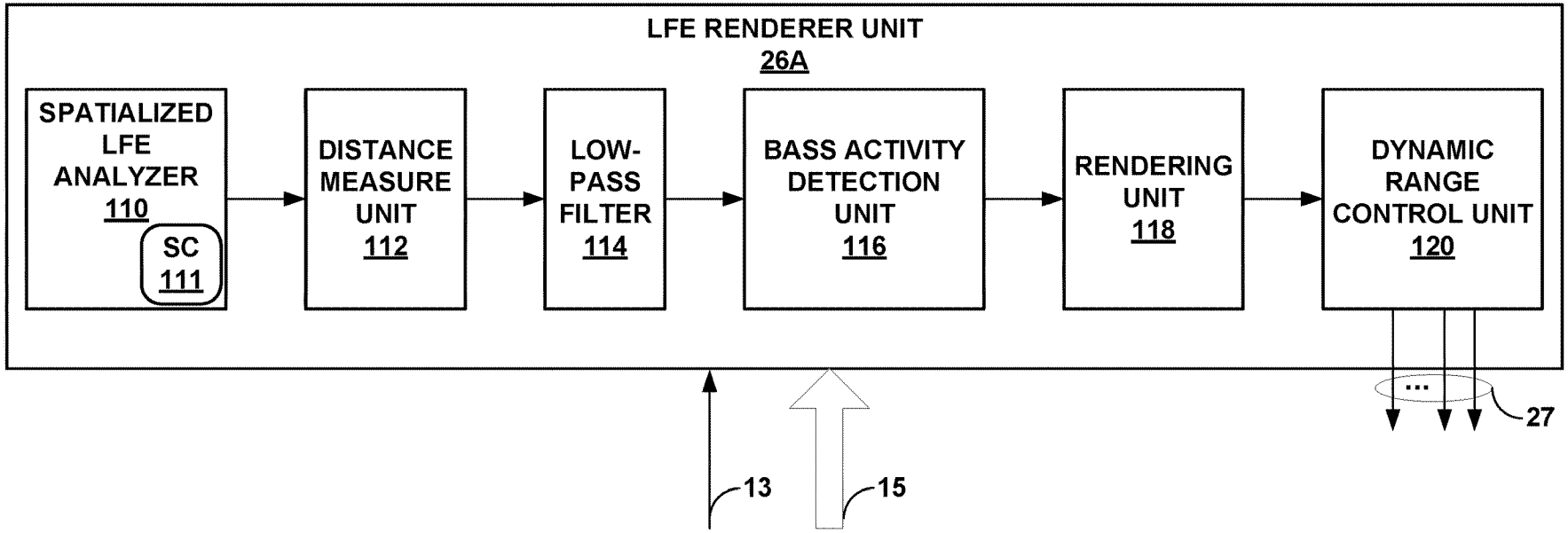
FIG. 2 is a block diagram illustrating, in more detail, the LFE renderer unit shown in the example of FIG. 1.

FIG. 2 is a block diagram illustrating, in more detail, the LFE renderer unit shown in the example of FIG. 1. As shown in the example of FIG. 2, the LFE renderer unit 26A represents one example of the LFE renderer unit 26 shown in the example of FIG. 1, where the LFE renderer unit 26A includes a spatialized LFE analyzer 110, a distance measure unit 112, a low-pass filter 114, a bass activity detection unit 116, a rendering unit 118, and a dynamic range control (DRC) unit 120.

The spatialized LFE analyzer 110 may represent a unit configured to identify the spatial characteristics ("SC") 111 of the LFE components of the soundfield represented by the audio data 15. That is, the spatialized LFE analyzer 110 may obtain the audio data 15 and analyze the audio data 15 to identify the SC 111. The spatialized LFE analyzer 110 may analyze the full frequency audio data 15 to produce the spherical heatmap, representative of the directional acoustic energy (which may also be referred to as level or gain) surrounding the sweet spot. The spatialized LFE analyzer 110 may then identify, based on the spherical heatmap, the SC 111 of the LFE components of the soundfield. As noted above, the SC 111 of the LFE component may include one or more directions (e.g., a direction of arrival), one or more associated shapes, and the like.

The spatialized LFE analyzer 110 may generate the spherical heatmap in a number of different ways depending on the format of the audio data 15. In the example of channel-based audio data, the spatialized LFE analyzer 110 may directly produce the spherical heatmap from the channels, where each channel is defined as residing to a distinct location in space (e.g., as part of the 5.1 audio format). For object-based audio data, the LFE analyzer 110 may forgo generation of the spherical heatmap, as the object metadata may directly define a location at which the associated object resides. The LFE analyzer 110 may process all of the objects to identify which of the objects contribute to the LFE components of the soundfield, and identify the SC 111 based on the object metadata associated with the identified objects.

As an alternative to or in conjunction with the above metadata based identification of the SC 111, the spatialized LFE analyzer 110 may transform the object audio data 15 from the spatial domain to the spherical harmonic domain, producing HOA coefficients representative of each of the objects. The spatialized LFE analyzer 110 may next mix all of the HOA coefficients from each of the objects together, and transform the HOA coefficients from the spherical harmonic domain back to the spatial domain, producing channels (or, in other words, render the HOA coefficients into channels). The rendered channels may be equally spaced about a sphere surrounding the listener. The rendered channels may form the basis for the spherical heatmap. The spatialized LFE analyzer 110 may perform a similar operation to that described above in the instance of scene-based audio data (referring to the rendering of the channels from the HOA coefficients that are then used to generate the spherical heatmap, which again may also be referred to as an energy map).

The spatialized LFE analyzer 110 may output the SC 111 to one or more of the distance measure unit 112, the low-pass filter 114, the bass activity detection unit 116, the rendering unit 118, and/or the dynamic range control unit 120. The distance measure unit 112 may determine a distance between where the LFE component is originating (as indicated by the SC 111 or derived therefrom) and each LFE-capable speaker. The distance measure unit 112 may then select the one of the LFE-capable speakers having the smallest determined distance. When there is only a single LFE-capable speaker, the LFE rendering unit 26A may not invoke the distance measure unit 112 to compute or otherwise determine the distance.

The low-pass filter 114 may represent a unit configured to perform low-pass filtering with respect to the audio data 15 to obtain LFE components of the audio data 15. To conserve processing cycles and thereby promote more efficient operation (with the associated benefits of lower power consumption, bandwidth—including memory bandwidth—utilization, etc.), the low-pass filter 114 may select only those channels (for channel-based audio data) from the direction identified by the SC 111. However, in some examples, the low-pass filter 114 may apply a low-pass filter to the entirety of the audio data 15 to obtain the LFE components. The low-pass filter 114 may output the LFE components to the bass activity detection unit 116.

The bass activity detection unit 116 may represent a unit configured to detect whether, for a given frame of the LFE component, includes bass or not. The bass activity detection unit 116 may apply a noise floor threshold (e.g., 20 decibels—dB) to each frame of the LFE component. Although described with respect to a static threshold, the bass activity detection unit 116 may use a histogram (over time) to set a dynamic noise floor threshold.

When the gain (as defined in dB) of the LFE component exceeds or is equal to the noise floor threshold, the bass activity detection unit 116 may indicate that the LFE component is active for the current frame and is to be rendered. When the gain of the LFE component is below the noise floor threshold, the bass activity detection unit 116 may indicate that the LFE component is not active for the current frame and is not to be rendered. The bass activity detection unit 116 may output this indication to rendering unit 118.

When the indication indicates that the LFE component is active for the current frame, the rendering unit 118 may render, based on the SC 111 and the speaker information 13, the LFE-capable speaker feeds 27. That is, for channel-based audio data, the rendering unit 118 may weight the channels according to the SC 111 to potentially emphasize a direction from which the LFE component is originating in the soundfield. As such, the rendering unit 118 may apply, based on the SC 111, a first weight to a first audio channel of a number of audio channels that is different than a second weight applied to a second audio channel of the number of audio channels to obtain a first weighted audio channel. The rendering unit 118 may next mix the first weighted audio channel with a second weighted audio channel obtained by applying the second weight to the second audio channel to obtain a mixed audio channel. The rendering unit 118 may then obtain, based on the mixed audio channel, the one or more LFE-capable speaker feeds 27.

For object-based audio data, the rendering unit 118 may adjust an object rendering matrix to account for the direction of arrival of the LFE component, using the SC 111 as the direction of arrival. For scene-based audio data, the rendering unit 118 may adjust a similar HOA rendering matrix to account for the direction of arrival of the LFE component, again using the SC 111 as the direction of arrival. Regardless of the type of audio data, the rendering unit 118 may utilize the speaker information 13 to determine various aspects of the rendering weights/matrix (as well as any delays, crossover, etc.) to account for differences between the specified locations of the speakers (such as by the 5.1 format) to the actual locations of the LFE capable speakers.

The rendering unit 118 may perform various types of rendering, such as object-based rendering types including vector based amplitude panning (VBAP), distance-based amplitude panning (DBAP), and/or ambisonic-based rendering types. In instances, where more than one LFE capable speaker is present, the rendering unit 118 may perform VBAP, DBAP, and/or the ambisonic-based rendering types so as to create an audible appearance of a virtual speaker located at the direction of arrival defined by the SC 111. That is, when the audio playback device 16 is coupled to a plurality of low frequency effects capable speakers, the rendering unit 118 may be configured to process, based on the SC 111, the audio data to render a first low frequency effects speaker feed and a second low frequency effects speaker feed, the first low frequency effects speaker feed being different than the second low frequency effects speaker feed. Rather than render different low frequency effects speaker feeds, the rendering unit 118 may perform VBAP to localize the direction of arrival of the low frequency effects components.

When the indication indicates that the LFE component is not active for the current frame, the rendering unit 118 may refrain from rendering the current frame. In any event, the rendering unit 118 may output, when the LFE component is indicated as being active, the LFE capable speaker feeds 27 to the dynamic range control (DRC) unit 120.

The dynamic range control unit 120 may ensure that the dynamic range of the LFE-capable speaker feeds 27 remains within a maximum gain to avoid damaging the LFE-capable speaker feeds 27. As the tolerances may differ on a per speaker basis, the dynamic range control unit 120 may ensure that the LFE-capable speakers feeds 27 remain below a maximum gain defined for each of the LFE-capable speakers (or identified automatically by the dynamic range control unit 120 or other components within the audio playback system 16). The dynamic range control unit 120 may output the adjusted LFE-capable speaker feeds 27 to the LFE-capable speakers.

Figure 3:
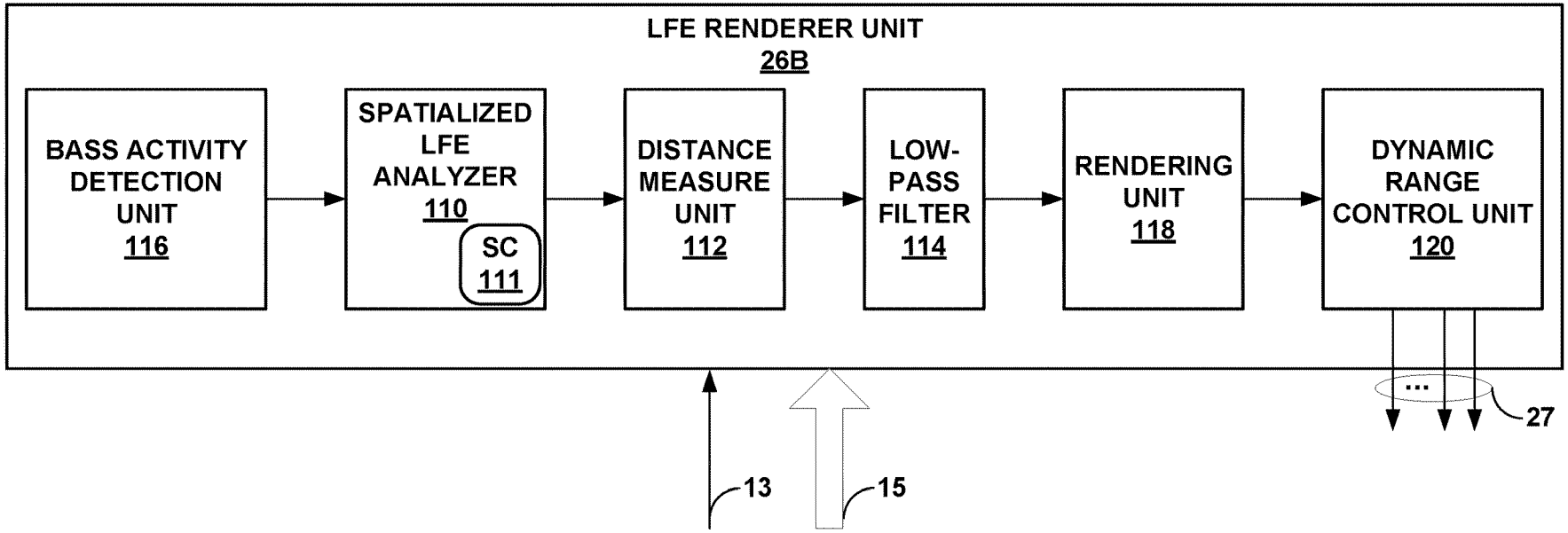
FIG. 3 is a block diagram illustrating, in more detail, another example of the LFE renderer unit shown in FIG. 1.

FIG. 3 is a block diagram illustrating, in more detail, another example of the LFE renderer unit shown in FIG. 1. As shown in the example of FIG. 3, the LFE renderer unit 26B represents one example of the LFE renderer unit 26 shown in the example of FIG. 1, where the LFE renderer unit 26B includes the same spatialized LFE analyzer 110, the distance measure unit 112, the low-pass filter 114, the bass activity detection unit 116, the rendering unit 118, and the dynamic range control (DRC) unit 120 as discussed above with respect to the LFE renderer unit 26A. However, the LFE renderer unit 26B differs from the LFE renderer unit 26A, as the bass activity detection unit 116 is first to process the audio data 15, thereby potentially improving processing efficiency given that frames having no bass activity are skipped thereby avoiding processing by the spatialized LFE analyzer 110, the distance measure unit 112, and the low-pass filter 114.

Figure 4:
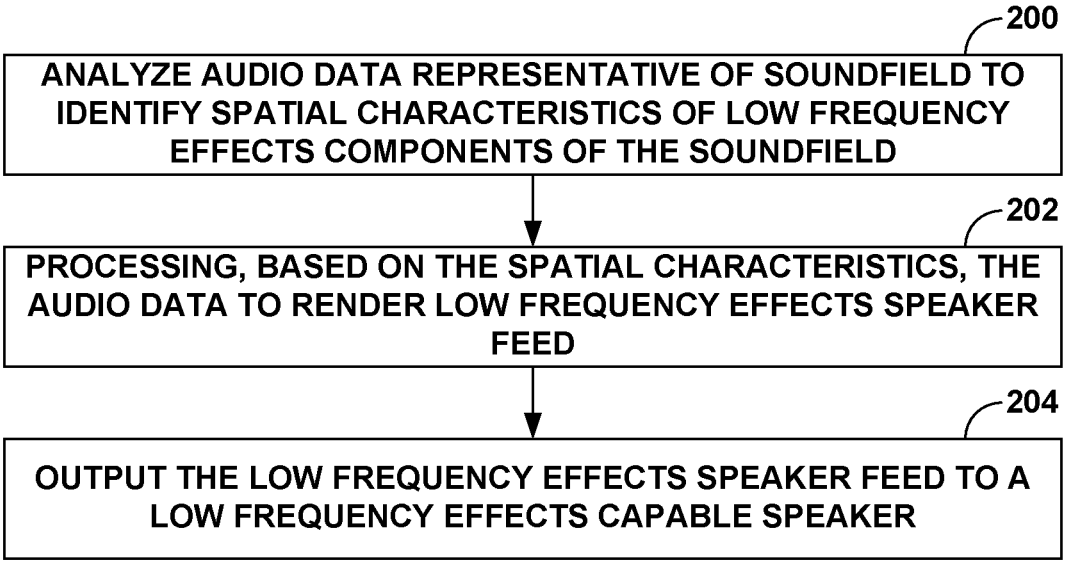
FIG. 4 is a flowchart illustrating example operation of the LFE renderer unit shown in FIGS. 1-3 in performing various aspects of low frequency effects rendering techniques.

FIG. 4 is a flowchart illustrating example operation of the LFE renderer unit shown in FIGS. 1-3 in performing various aspects of low frequency effects rendering techniques. The LFE renderer unit 26 may analyze the audio data 15 representative of a soundfield to identify the SC 111 of low frequency effects components of the soundfield (200). To perform the analysis, the LFE renderer unit 26 may generate, based on the audio data 15, a spherical heatmap representative of energy surrounding a listener located at a middle of a sphere (in the sweet spot). The LFE renderer unit 26 may select a direction at which the most energy is localized, as described above in more detail.

The LFE renderer unit 26 may next process, based on the SC 111, the audio data to render one or more low frequency effects speaker feeds (202). As discussed above with respect to the example of FIG. 2, the LFE renderer unit 26 may adapt rendering unit 118 to differently weight each channel (for channel-based audio data), object (for object-based audio data), and/or various HOA coefficients (for scene-based audio data) based on the SC 111.

For example, should a direction of arrival defined by the SC 111 indicate that the LFE component is primarily arriving from the right side of the listener, the LFE renderer unit 26 may configure the rendering unit 118 to weight a right channel higher than a left channel (or to entirely discard the left channel as it may have little to no LFE components). In the object domain for the same direction as in the channel case above, the LFE renderer unit 26 may configure the rendering unit 118 to weight an object responsible for the majority of the energy (and whose metadata indicates that the object resides on the right) over an object to the left of the listener (or to discard the object to the left of the listener). In the context of scene-based audio data and for the same example direction as discussed above, the LFE renderer unit 26 may configure the rendering unit 118 to weight right channels rendered from the HOA coefficients over left channels rendered from the HOA coefficients.

The LFE renderer unit 26 may output the low frequency effects speaker feed 27 to a low frequency effects capable speaker (204). Although described above as generating the low frequency effects speaker feed 27 from a single type of the audio data 15 (e.g., scene-based audio data), the techniques may be performed with respect to mixed format audio data in which there is two or more of channel-based audio data, object-based audio data, or scene-based audio data for the same frame of time.

Figure 5:
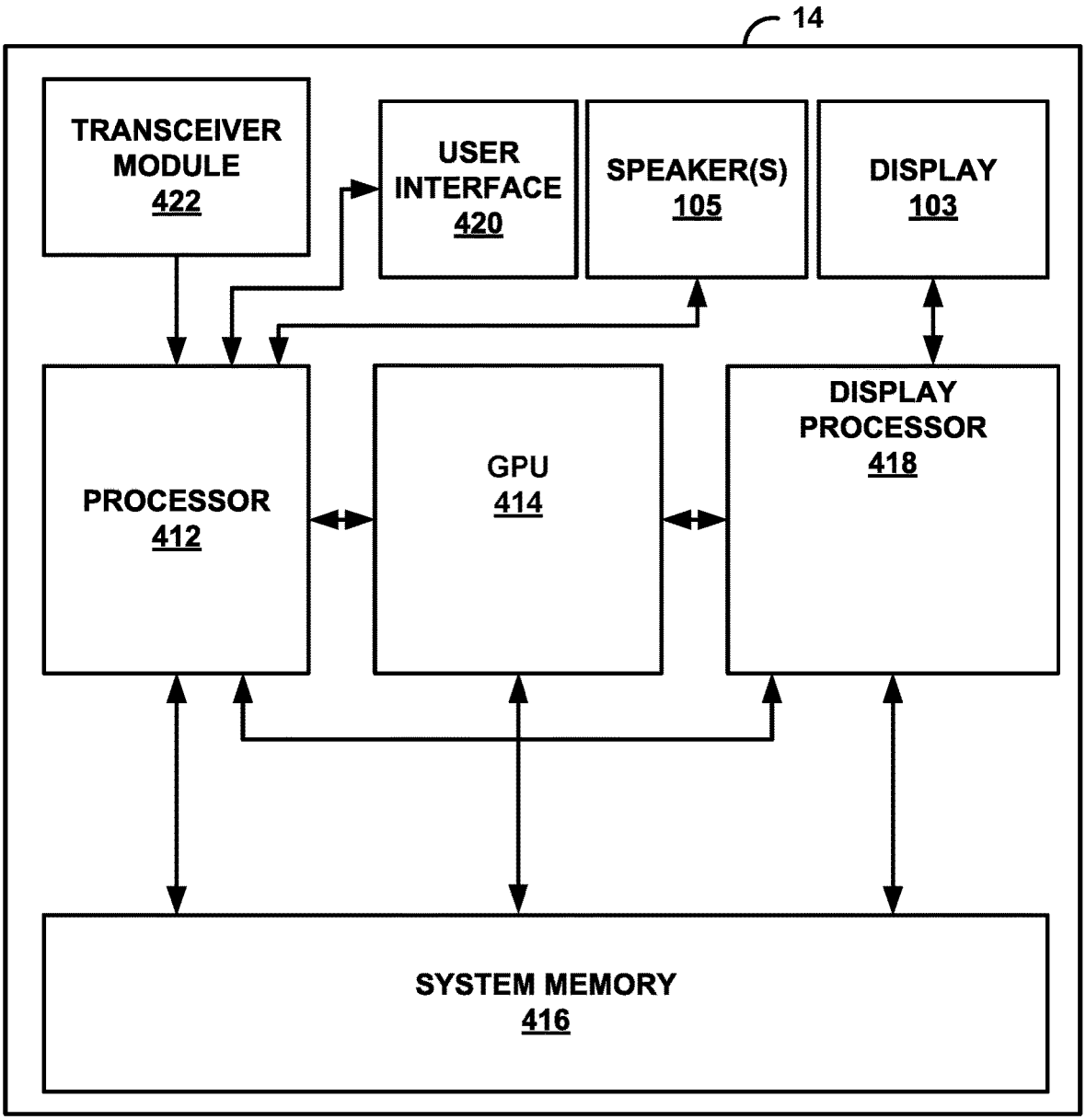
FIG. 5 is a block diagram illustrating example components of the content consumer device 14 shown in the example of FIG. 1.

FIG. 5 is a block diagram illustrating example components of the content consumer device 14 shown in the example of FIG. 1. In the example of FIG. 5, the content consumer device 14 includes a processor 412, a graphics processing unit (GPU) 414, system memory 416, a display processor 418, one or more integrated speakers 105, a display 103, a user interface 420, and a transceiver module 422. In examples where the content consumer device 14 is a mobile device, the display processor 418 is a mobile display processor (MDP). In some examples, such as examples where the content consumer device 14 is a mobile device, the processor 412, the GPU 414, and the display processor 418 may be formed as an integrated circuit (IC).

For example, the IC may be considered as a processing chip within a chip package and may be a system-on-chip (SoC). In some examples, two of the processors 412, the GPU 414, and the display processor 418 may be housed together in the same IC and the other in a different integrated circuit (i.e., different chip packages) or all three may be housed in different ICs or on the same IC. However, it may be possible that the processor 412, the GPU 414, and the display processor 418 are all housed in different integrated circuits in examples where the content consumer device 14 is a mobile device.

Examples of the processor 412, the GPU 414, and the display processor 418 include, but are not limited to, fixed function and/or programmable processing circuitry such as one or more digital signal processors (DSPs), general purpose microprocessors, application specific integrated circuits (ASICs), field programmable logic arrays (FPGAs), or other equivalent integrated or discrete logic circuitry. The processor 412 may be the central processing unit (CPU) of the content consumer device 14. In some examples, the GPU 414 may be specialized hardware that includes integrated and/or discrete logic circuitry that provides the GPU 414 with massive parallel processing capabilities suitable for graphics processing. In some instances, GPU 414 may also include general purpose processing capabilities, and may be referred to as a general-purpose GPU (GPGPU) when implementing general purpose processing tasks (i.e., non-graphics related tasks). The display processor 418 may also be specialized integrated circuit hardware that is designed to retrieve image content from the system memory 416, compose the image content into an image frame, and output the image frame to the display 103.

The processor 412 may execute various types of the applications 20. Examples of the applications 20 include web browsers, e-mail applications, spreadsheets, video games, other applications that generate viewable objects for display, or any of the application types listed in more detail above. The system memory 416 may store instructions for execution of the applications 20. The execution of one of the applications 20 on the processor 412 causes the processor 412 to produce graphics data for image content that is to be displayed and the audio data 21 that is to be played (possibly via integrated speaker 105). The processor 412 may transmit graphics data of the image content to the GPU 414 for further processing based on and instructions or commands that the processor 412 transmits to the GPU 414.

The processor 412 may communicate with the GPU 414 in accordance with a particular application processing interface (API). Examples of such APIs include the DirectX® API by Microsoft®, the OpenGL® or OpenGL ES® by the Khronos group, and the OpenCL'; however, aspects of this disclosure are not limited to the DirectX, the OpenGL, or the OpenCL APIs, and may be extended to other types of APIs. Moreover, the techniques described in this disclosure are not required to function in accordance with an API, and the processor 412 and the GPU 414 may utilize any technique for communication.

The system memory 416 may be the memory for the content consumer device 14. The system memory 416 may comprise one or more computer-readable storage media. Examples of the system memory 416 include, but are not limited to, a random-access memory (RAM), an electrically erasable programmable read-only memory (EEPROM), flash memory, or other medium that can be used to carry or store desired program code in the form of instructions and/or data structures and that can be accessed by a computer or a processor.

In some examples, the system memory 416 may include instructions that cause the processor 412, the GPU 414, and/or the display processor 418 to perform the functions ascribed in this disclosure to the processor 412, the GPU 414, and/or the display processor 418. Accordingly, the system memory 416 may be a computer-readable storage medium having instructions stored thereon that, when executed, cause one or more processors (e.g., the processor 412, the GPU 414, and/or the display processor 418) to perform various functions.

The system memory 416 may include a non-transitory storage medium. The term "non-transitory" indicates that the storage medium is not embodied in a carrier wave or a propagated signal. However, the term "non-transitory" should not be interpreted to mean that the system memory 416 is non-movable or that its contents are static. As one example, the system memory 416 may be removed from the content consumer device 14 and moved to another device. As another example, memory, substantially similar to the system memory 416, may be inserted into the content consumer device 14. In certain examples, a non-transitory storage medium may store data that can, over time, change (e.g., in RAM).

The user interface 420 may represent one or more hardware or virtual (meaning a combination of hardware and software) user interfaces by which a user may interface with the content consumer device 14. The user interface 420 may include physical buttons, switches, toggles, lights or virtual versions thereof. The user interface 420 may also include physical or virtual keyboards, touch interfaces—such as a touchscreen, haptic feedback, and the like.

The processor 412 may include one or more hardware units (including so-called "processing cores") configured to perform all or some portion of the operations discussed above with respect to the LFE renderer unit 26 of FIG. 1. The transceiver module 422 may represent one or more receivers and one or more transmitters capable of wireless communication in accordance with one or more wireless communication protocols.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In some examples, the A/V device (or the AV and/or streaming device) may communicate, using a network interface coupled to a memory of the AV/streaming device, exchange messages to an external device, where the exchange messages are associated with the multiple available representations of the soundfield. In some examples, the A/V device may receive, using an antenna coupled to the network interface, wireless signals including data packets, audio packets, video packets, or transport protocol data associated with the multiple available representations of the soundfield. In some examples, one or more microphone arrays may capture the soundfield.

In some examples, the multiple available representations of the soundfield stored to the memory device may include a plurality of object-based representations of the soundfield, higher order ambisonic representations of the soundfield, mixed order ambisonic representations of the soundfield, a combination of object-based representations of the soundfield with higher order ambisonic representations of the soundfield, a combination of object-based representations of the soundfield with mixed order ambisonic representations of the soundfield, or a combination of mixed order representations of the soundfield with higher order ambisonic representations of the soundfield.

In some examples, one or more of the soundfield representations of the multiple available representations of the soundfield may include at least one high-resolution region and at least one lower-resolution region, and wherein the selected presentation based on the steering angle provides a greater spatial precision with respect to the at least one high-resolution region and a lesser spatial precision with respect to the lower-resolution region.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit.

Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable gate arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various examples have been described. These and other examples are within the scope of the following claims.

What is claimed is:

1. A device comprising:

a memory configured to store audio data representative of a soundfield; and one or more processors configured to:

analyze the audio data to identify spatial characteristics of low frequency effects components of the soundfield, wherein the spatial characteristics include one or more directions from which the low frequency effects components originate within the soundfield and a shape of the low frequency effects components within the soundfield;

processing, based on the spatial characteristics, the audio data to render a low frequency effects speaker feed; and output the low frequency effects speaker feed to a low frequency effects capable speaker.

2. The device of claim 1, wherein the device is coupled to the low frequency effects capable speaker, the low frequency effects capable speaker configured to reproduce, based on the low frequency effects speaker feed, a low frequency effects component of the soundfield.

3. The device of claim 1, wherein the one or more processors are configured to:

generate, based on the audio data, a spherical heatmap reflecting acoustical energy levels within the soundfield; and identify, based on the spherical heatmap, the spatial characteristics of the low frequency effects components of the soundfield.

4. The device of claim 1, wherein the audio data comprises channel-based audio data having a plurality of audio channels, wherein each audio channel of the plurality of audio channels is associated with a different location within the soundfield, and wherein the one or more processors are configured to:

apply, based on the spatial characteristics, a first weight to a first audio channel of the plurality of audio channels that is different than a second weight applied to a second audio channel of the plurality of audio channels to obtain a first weighted audio channel;

mix the first weighted audio channel with a second weighted audio channel obtained by applying the second weight to the second audio channel to obtain a mixed audio channel; and determine, based on the mixed audio channel, the low frequency effects capable speaker feed.

5. The device of claim 1, wherein the audio data comprises object-based audio data, the object-based audio data including an audio object and metadata indicating where in the soundfield the audio objects originates, and wherein the one or more processors are configured to:

extract the metadata from the object-based audio data; and identify, based on the metadata, the spatial characteristics.

6. The device of claim 1, wherein the audio data comprises object-based audio data, the object-based audio data defining a plurality of audio objects, and wherein the one or more processors are configured to:

transform each of the plurality of audio objects from a spatial domain into a spherical harmonic domain to obtain a corresponding set of higher order ambisonic coefficients;

mix each of the corresponding sets of higher order ambisonic coefficients into a single set of higher order ambisonic coefficients; and analyze the single set of higher order ambisonic coefficients to identify the spatial characteristics.

7. The device of claim 1, wherein the audio data comprises scene-based audio data, the scene-based audio data including higher order ambisonic coefficients, and wherein the one or more processors are configured to:

render the scene-based audio data to one or more audio channels; and analyze the one or more audio channels to identify the spatial characteristics.

8. The device of claim 7, wherein the one or more audio channels are equally distributed around a sphere representative of the soundfield.

9. The device of claim 1, wherein the device is coupled to a plurality of low frequency effects capable speakers, wherein the low frequency effects speaker feed is a first low frequency effects speaker feed, and wherein the one or more processors are configured to process, based on the spatial characteristics, the audio data to render the first low frequency effects speaker feed and a second low frequency effects speaker feed, the first low frequency effects speaker feed being different than the second low frequency effects speaker feed.

10. A method comprising:

analyzing audio data representative of a soundfield to identify spatial characteristics of low frequency effects components of the soundfield, wherein the spatial characteristics include one or more directions from which the low frequency effects components originate within the soundfield and a shape of the low frequency effects components within the soundfield;

processing, based on the spatial characteristics, the audio data to render a low frequency effects speaker feed; and outputting the low frequency effects speaker feed to a low frequency effects capable speaker.

11. The method of claim 10, further comprising reproducing, based on the low frequency effects speaker feed, a low frequency effects component of the soundfield.

12. The method of claim 10, wherein analyzing the audio data comprises:

generating, based on the audio data, a spherical heatmap reflecting acoustical energy levels within the soundfield; and identifying, based on the spherical heatmap, the spatial characteristics of the low frequency effects components of the soundfield.

13. The method of claim 10, wherein the audio data comprises channel-based audio data having a plurality of channels of audio data, wherein each audio channel of the plurality of audio channels is associated with a different location within the soundfield, and wherein processing the audio data comprises:

applying, based on the spatial characteristics, a first weight to a first audio channel of the plurality of audio channels that is different than a second weight applied to a second audio channel of the plurality of audio channels to obtain a first weighted audio channel;

mixing the first weighted audio channel with a second weighted audio channel obtained by applying the second weight to the second audio channel to obtain a mixed audio channel; and determining, based on the mixed audio channel, the low frequency effects capable speaker feed.

14. The method of claim 10, wherein the audio data comprises object-based audio data, the object-based audio data including an audio object and metadata indicating where in the soundfield the audio objects originates, and wherein analyzing the audio data comprises:

extracting the metadata from the object-based audio data; and identifying, based on the metadata, the spatial characteristics.

15. The method of claim 10, wherein the audio data comprises object-based audio data, the object-based audio data defining a plurality of audio objects, and wherein analyzing the audio data comprises:

transforming each of the plurality of audio objects from a spatial domain into a spherical harmonic domain to obtain a corresponding set of higher order ambisonic coefficients;

mixing each of the corresponding sets of higher order ambisonic coefficients into a single set of higher order ambisonic coefficients; and analyzing the single set of higher order ambisonic coefficients to identify the spatial characteristics.

16. The method of claim 10, wherein the audio data comprises scene-based audio data, the scene-based audio data including higher order ambisonic coefficients, and wherein analyzing the audio data comprises:

rendering the scene-based audio data to one or more audio channels; and analyzing the one or more audio channels to identify the spatial characteristics.

17. The method of claim 16, wherein the one or more audio channels are equally distributed around a sphere representative of the soundfield.

18. The method of claim 10, wherein the low frequency effects speaker feed is a first low frequency effects speaker feed, and wherein processing the audio data comprises processing, based on the spatial characteristics, the audio data to render the first low frequency effects speaker feed and a second low frequency effects speaker feed, the first low frequency effects speaker feed being different than the second low frequency effects speaker feed.

19. A device comprising:

means for analyzing audio data representative of a soundfield to identify spatial characteristics of low frequency effects components of the soundfield, wherein the spatial characteristics include one or more directions from which the low frequency effects components originate within the soundfield and a shape of the low frequency effects components within the soundfield;

means for processing, based on the spatial characteristics, the audio data to render a low frequency effects speaker feed; and means for outputting the low frequency effects speaker feed to a low frequency effects capable speaker.

20. The device of claim 19, further comprising means for reproducing, based on the low frequency effects speaker feed, a low frequency effects component of the soundfield.

21. The device of claim 19, wherein the means for analyzing the audio data comprises:

means for generating, based on the audio data, a spherical heatmap reflecting acoustical energy levels within the soundfield; and means for identifying, based on the spherical heatmap, the spatial characteristics of the low frequency effects components of the soundfield.

22. The device of claim 19, wherein the audio data comprises channel-based audio data having a plurality of channels of audio data, wherein each audio channel of the plurality of audio channels is associated with a different location within the soundfield, and wherein the means for processing the audio data comprises:

means for applying, based on the spatial characteristics, a first weight to a first audio channel of the plurality of audio channels that is different than a second weight applied to a second audio channel of the plurality of audio channels to obtain a first weighted audio channel;

means for mixing the first weighted audio channel with a second weighted audio channel obtained by applying the second weight to the second audio channel to obtain a mixed audio channel; and means for determining, based on the mixed audio channel, the low frequency effects capable speaker feed.

23. The device of claim 19, wherein the audio data comprises object-based audio data, the object-based audio data including an audio object and metadata indicating where in the soundfield the audio objects originates, and wherein the means for analyzing the audio data comprises:

means for extracting the metadata from the object-based audio data; and means for identifying, based on the metadata, the spatial characteristics.

24. The device of claim 19, wherein the audio data comprises object-based audio data, the object-based audio data defining a plurality of audio objects, and wherein the means for analyzing the audio data comprises:

means for transforming each of the plurality of audio objects from a spatial domain into a spherical harmonic domain to obtain a corresponding set of higher order ambisonic coefficients;

means for mixing each of the corresponding sets of higher order ambisonic coefficients into a single set of higher order ambisonic coefficients; and means for analyzing the single set of higher order ambisonic coefficients to identify the spatial characteristics.

25. The device of claim 19, wherein the audio data comprises scene-based audio data, the scene-based audio data including higher order ambisonic coefficients, and wherein the means for analyzing the audio data comprises:

means for rendering the scene-based audio data to one or more audio channels; and means for analyzing the one or more audio channels to identify the spatial characteristics.

26. The device of claim 25, wherein the one or more audio channels are equally distributed around a sphere representative of the soundfield.

27. The device of claim 19, wherein the low frequency effects speaker feed is a first low frequency effects speaker feed, and wherein the means for processing the audio data comprises means for processing, based on the spatial characteristics, the audio data to render the first low frequency effects speaker feed and a second low frequency effects speaker feed, the first low frequency effects speaker feed being different than the second low frequency effects speaker feed.

28. A non-transitory computer-readable storage medium having stored thereon instructions that, when executed, cause one or more processors of a device to:

analyze audio data representative of a soundfield to identify spatial characteristics of low frequency effects components of the soundfield, wherein the spatial characteristics include one or more directions from which the low frequency effects components originate within the soundfield and a shape of the low frequency effects components within the soundfield;

process, based on the spatial characteristics, the audio data to render a low frequency effects speaker feed; and output the low frequency effects speaker feed to a low frequency effects capable speaker.

* * * * *